US006619447B1

(12) United States Patent
Garcia, III et al.

(10) Patent No.: US 6,619,447 B1
(45) Date of Patent: Sep. 16, 2003

(54) UTILITY BAG HAVING A PRIMARY BAG AND A RELEASABLY ATTACHED AUXILIARY BAG

(76) Inventors: Trinidad Garcia, III, 1502 Crespi Dr., Oxnard, CA (US) 93033; Trinidad Garcia, Jr., 1502 Crespi Dr., Oxnard, CA (US) 93033

( * ) Notice: Subject to any disclaimer, the term of this patent is extended or adjusted under 35 U.S.C. 154(b) by 0 days.

(21) Appl. No.: 10/139,790

(22) Filed: May 7, 2002

(51) Int. Cl.[7] ..... A45C 5/02; A45C 13/10; A45C 13/36

(52) U.S. Cl. ..... 190/108; 190/110; 190/127; 150/113; 150/111; 383/37

(58) Field of Search ..... 190/108, 110, 190/126; 150/111, 113; 383/37

(56) References Cited

U.S. PATENT DOCUMENTS

| | | | | | |
|---|---|---|---|---|---|
| 3,696,850 | A | * | 10/1972 | Rosenblum | 190/108 |
| 4,116,311 | A | * | 9/1978 | Davis | 190/126 |
| 4,170,282 | A | * | 10/1979 | Schwartzstein | 190/108 X |
| 4,424,841 | A | * | 1/1984 | Smith | 190/108 X |
| 4,437,549 | A | * | 3/1984 | Gibbs | 190/126 X |
| 4,685,546 | A | * | 8/1987 | Sadow | 190/108 X |
| 4,756,394 | A | * | 7/1988 | Cohen | 190/108 X |
| 5,005,679 | A | * | 4/1991 | Hjelle | 190/108 X |
| 5,009,319 | A | * | 4/1991 | Jantzen | 150/113 X |
| 5,050,713 | A | * | 9/1991 | Lee | 383/37 X |
| 5,267,679 | A | * | 12/1993 | Kamaya et al. | 190/108 X |
| 5,402,869 | A | * | 4/1995 | Saltzman et al. | 190/108 |
| 5,413,199 | A | * | 5/1995 | Clement | 190/108 |
| 5,660,476 | A | * | 8/1997 | DeCoster | 190/108 X |
| 5,873,504 | A | * | 2/1999 | Farmer | 150/113 X |
| 6,076,485 | A | * | 6/2000 | Peeples et al. | 190/108 X |

FOREIGN PATENT DOCUMENTS

| | | | | |
|---|---|---|---|---|
| DE | 3600794 | * | 8/1986 | 190/110 |
| GB | 2260894 | * | 5/1993 | 383/37 |

* cited by examiner

*Primary Examiner*—Sue A. Weaver
(74) *Attorney, Agent, or Firm*—Albert O. Cota

(57) ABSTRACT

A utility bag (10) comprised of a primary bag (12) and a releasably attached auxiliary bag (30. When the auxiliary bag (30) is attached to the primary bag (12), various items, such as sporting equipment, can be placed in each respective bag (12),(30) and carried together when desirable, the auxiliary bag (30) can be detached from the primary bag (12) by utilizing two sets of buckles. The primary bag (12) includes a plurality of straps which allow the primary bag (12) to be worn over a shoulder, such as a purse or carried by hand by utilizing a hand grip (102). The auxiliary bag (30), when detached, can be held by an attached carrying handle (118), or worn as a backpack by utilizing a separate pair of back straps. Both the primary bag (12) and the auxiliary bag (30) are constructed of a strong waterproof material and both bags utilize zippers to gain access to the bag's interior.

6 Claims, 3 Drawing Sheets

UTILITY BAG HAVING A PRIMARY BAG AND A RELEASABLY ATTACHED AUXILIARY BAG

TECHNICAL FIELD

The invention pertains to the general field of utility bags and more particularly to an utility bag that includes a releasably attached auxiliary bag.

BACKGROUND ART

For as long as people have traveled from one location to another, there has been a need or desire to take selected items along with them. Nomadic tribes and other individuals seeking a new home had to take everything they owned. In today's world there are also many scenarios in which people bring items with them, such as vacationers, travelling businessmen, and campers or other recreation-seeking individuals.

One of the most popular methods of carrying items is a bag or tote, which has handles or straps for holding. The bags are typically made of a strong, resilient material such as nylon, cotton or leather and can range in size from small, single-hand type bags to large, shoulder-harnessed duffles. The bags usually include some type of means of keeping the bag closed, such as a zipper, snap-type buttons or a hook and loop fastener.

Unfortunately, many bags are designed with a single inner area, which precludes separating items that are put in the bag. This design has caused certain problems, such as people having to put dirty clothes together with clean clothes, items with sharp corners with items that tear easily, or even food with other supplies. Being able to separate items that are carried at one time is also beneficial for many sporting activities, such as soccer, that require clothes and equipment, such as a ball to be carried.

Obviously, if there were some way of carrying multiple items, while maintaining the items separately would be beneficial for many different people and situations.

A search of the prior art did not disclose any U.S. patents or industry catalogs and publications that read on the claims of the instant application.

DISCLOSURE OF THE INVENTION

In its most basic design, the utility bag is comprised of a primary bag having an upper surface, a lower surface, a front surface, a rear surface, a first side and a second side. An auxiliary bag is releasably attached to a first side of the primary bag and includes an upper seam that interfaces with an upper edge of a front surface and an upper edge of a rear surface, a lower surface, a first side and a second side. In order to releasably attach the rear surface of the auxiliary bag against the first side of the primary bag, an attachment means is utilized. The attachment means can comprise a buckle pair, a hook and loop fastener, snap-type buttons or any other type of device that permits attachment and release.

In view of the above disclosure, the primary object of the invention is to provide an utility bag which, in addition to comprising a primary, single enclosure, also includes a second enclosure that can be attached and removed from the primary enclosure.

It is also an object of the invention to provide an utility bag that:

can be made in a variety of sizes for many purposes, allows items to be carried concurrently, yet stored separate, can be made from various materials, such as a light-weight, easy to carry material, or a heavy, but very strong material, can be carried, such as a purse, allows the auxiliary bag to be carried or worn as a backpack, and is cost effective from both a manufacturer's and consumer's point of view.

BEST MODE FOR CARRYING OUT THE INVENTION

The best mode for carrying out the invention is presented in terms of a preferred embodiment for a utility bag having a detachable auxiliary bag. The utility bag 10, as shown in FIGS. 1–5, is comprised of three major elements: a primary bag 12, an auxiliary bag 30, and a means 132 for releasably attaching the auxiliary bag 30 to the primary bag 12.

Figure 1:
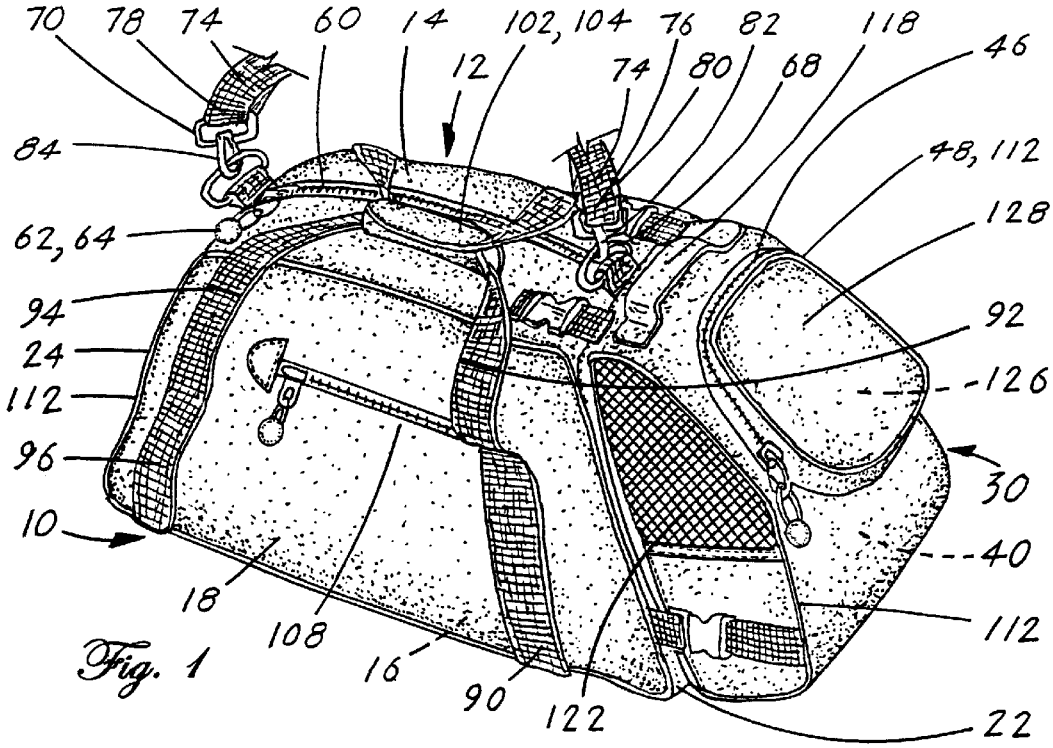
FIG. 1 is a perspective view of an utility bag consisting of a primary bag having a first side to which is releasably attached an auxiliary bag.
Figure 2:
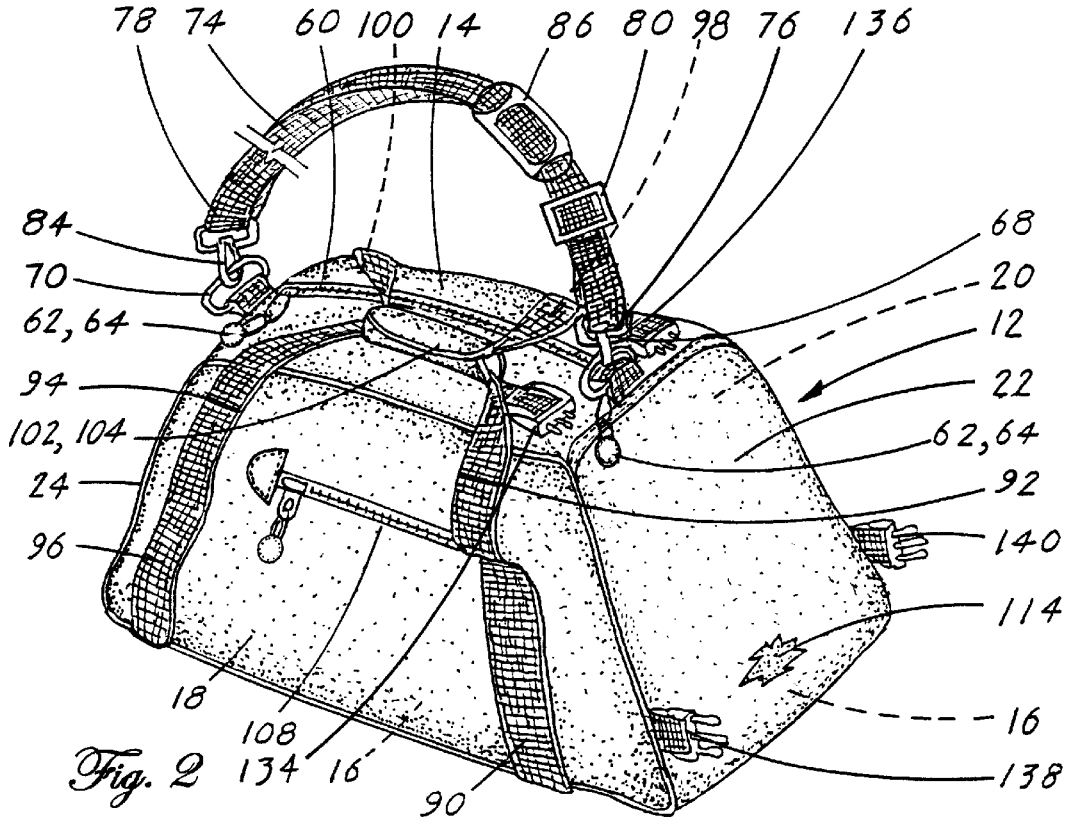
FIG. 2 is a perspective view of the primary bag.
Figure 3:
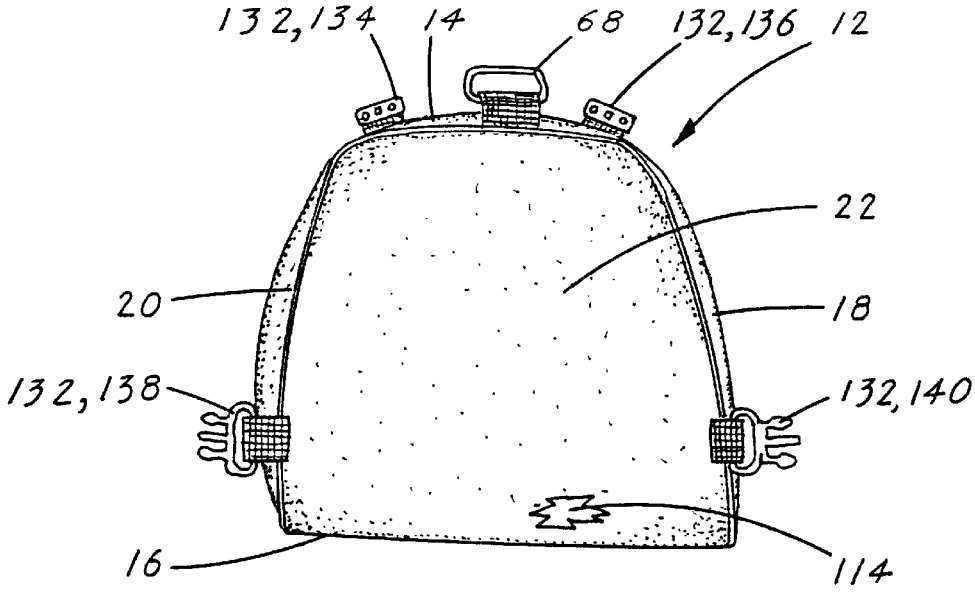
FIG. 3 is an elevational view of the first side of the primary bag.
Figure 4:
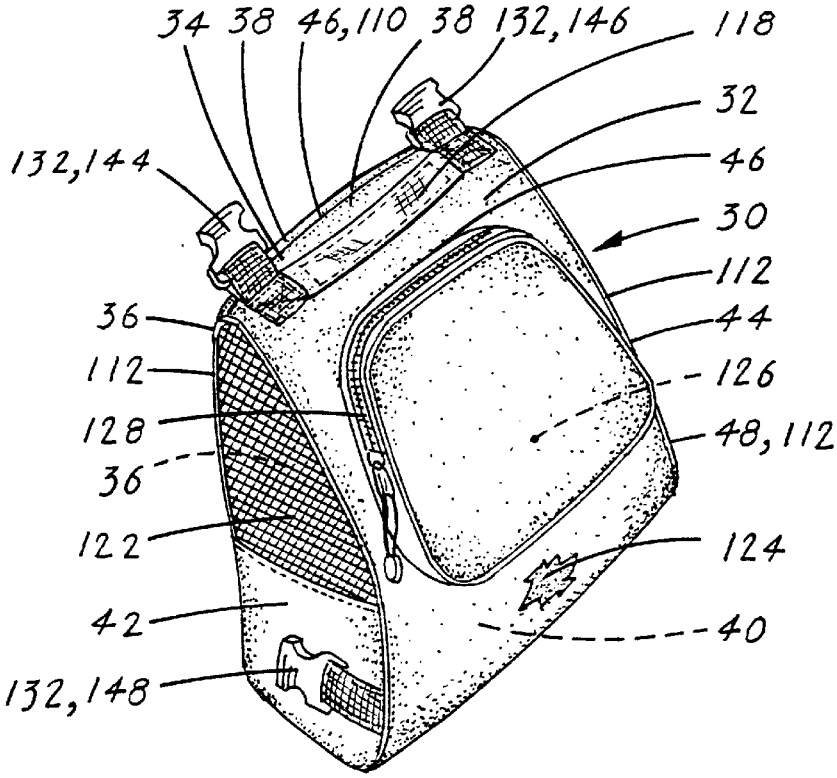
FIG. 4 is a perspective view showing the front surface and the first side of a detached auxiliary bag. The opposite view being a mirror image.
Figure 5:
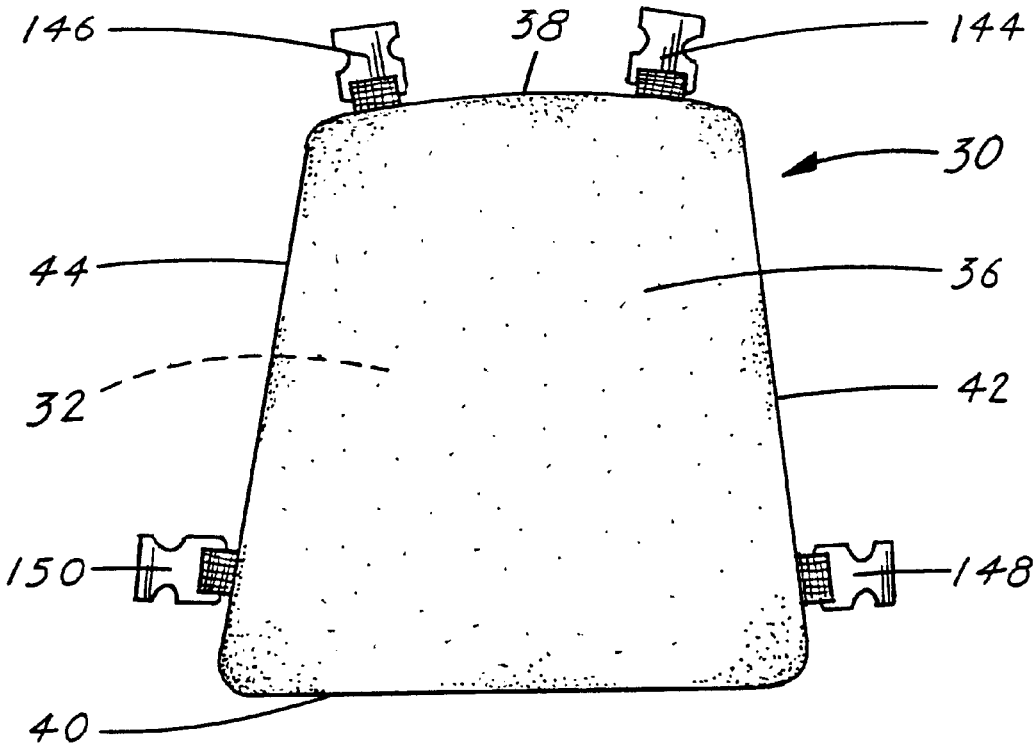
FIG. 5 is an elevational view of the rear surface of the auxiliary bag.

The primary bag 12, as shown in FIGS. 1, 2 and 3, is comprised of an upper surface 14, a lower surface 16, a front surface 18, a rear surface 20, a first side 122 and a second side 24. The auxiliary bag 30, as shown in FIGS. 1, 4 and 5, is comprised of a front surface 32 having an upper edge 34, a rear surface 36 having an upper edge 38, a lower surface 40, a first side 42, a second side 44, and an upper seam 46 that joins the upper edge 34 of the front surface 32 and the upper edge 38 of the rear surface 36.

The primary bag 12 further comprises a zipper 60 that is substantially centered across the upper surface 14 of the primary bag 12, as shown in FIGS. 1 and 2. The zipper 60 can include a pair of zipper pull tabs 62, with each pull tab 62 having a corded zipper slider 64 attached thereto, as shown in FIG. 2. The dual zipper pull tabs 62 allow the zipper 60 to be opened or closed from either end.

As shown in FIG. 1, the utility bag 10 has a first D-ring 68 attached by means of a tab to the upper surface 14 of the primary bag 12 adjacent the upper end of the first side 22. A second D-ring 70 is similarly attached to the upper surface 14 of the primary bag 12 adjacent the upper end of the second side 24.

As shown in FIG. 2, the primary bag 12 also comprises a shoulder carrying strap 74 having a first end 76 and a second end 78. Near the first end 76 is located an adjustable loop 80, which has a first swivel hook 82 attached that releasably engages the first D-ring 68. The second end 78 has attached a second swivel hook 84 that releasably engages the second D-ring 70. Substantially centered on the strap 74 is a non-slip shoulder pad 86, as shown in FIG. 2, that is slidably adjustable.

As also shown in FIG. 2, the primary bag 12 comprises a first bag carrying strap 90 and a second bag carrying strap 96. The first bag carrying strap 90 has a first end 92 and a second end 94 attached respectively to the front surface 18, adjacent the first side 22 and the second side 24 of the primary bag 12. The second bag carrying strap 96 has a first end 98 and a second end 100 attached respectively by the rear surface 20, adjacent the first side 22 and the second side 24, of the primary bag 12. The first strap 90 has a substantially-centered hand grip 102, as shown in FIG. 2, that is dimensioned to wrap around the second strap 96 and to become attached by an attachment means 104, to form the hand grip 102. The hand grip 102 attachment means 104 is preferably comprised of a hook and loop fastener. The front surface 18 of the primary bag 12 further comprises a water-proof, zippered side pocket 108, as shown in FIGS. 1 and 2.

Both the primary bag 12 and the auxiliary bag are made of a water-proof, vinyl-backed polyester, with the zippered upper seam 46 of the auxiliary bag 30 covered internally with a binding tape 110 and the external side edge 48 incorporating a solid-bead welting 112, as shown in FIGS. 1 and 4.

As shown in FIG. 2, the primary bag 12 further comprises a removable, rigid liner 114 that is dimensioned to fit internally over the upper surface of the lower surface 16 to provide rigidity to the surface 16. The liner 114 is comprised of a polystyrene material that is covered with a taffeta material having a PVC backing.

The auxiliary bag 30, as shown in FIGS. 1, 4 and 5, further comprises a carrying handle 118 that is made of a cushioned polypropelene webbing. The handle 118 is attached across the auxiliary bag's front surface 32, adjacent the upper edge 34. The auxiliary bag 30 also has a portion of the first side 42 and the second side 44 consisting of a mesh material 122, as shown in FIGS. 2, and 4, that allows the contents of the auxiliary bag 30 to vent out of the bag 30. The auxiliary bag 30 further comprises a foam material 124 encompassing the internal surface of the lower surface 40 and a portion of the front and rear surfaces 32,36. The foam material 124 is designed to add rigidity to the lower surface 40 of the auxiliary bag 30.

As shown in FIGS. 1 and 4, the front surface 32 of the auxiliary bag 30 has an opening 126 that is covered by a zippered enclosure 128 which allows access into the auxiliary bag 30.

The attachment means 132, as shown in FIGS. 1, 4 and 5, for releasably attaching the auxiliary bag 30 to the primary bag 12 comprises two sets of buckles. As shown best in FIGS. 2 and 3, the primary bag 12 has a first male buckle 134 located on the upper surface 14 adjacent the intersection of the front surface 18 and the first side 22. A second male buckle 136 is located on the upper surface 14 adjacent the intersection of the rear surface 20 and the first side 22. A third male buckle 138 is located adjacent the lower surface 16 at the intersection of the front surface 18 and the first side 22. A fourth male buckle 140 is located adjacent the lower surface 16 at the intersection of the rear surface 20 and the first side 22.

As shown in FIGS. 4 and 5, the auxiliary bag 30 has a first female buckle 144 located on the upper seam 46 in alignment with the first male buckle 134. A second female buckle 146 is located on the upper seam 46 in alignment with the second male buckle 136. A third female buckle 148 is located on the first side 42 in alignment with the third male buckle 138. A fourth female buckle 150, as shown in FIG. 5, is located on the second side 44 in alignment with the fourth male buckle 140. Once each male buckle 134,136, 138,140 is inserted into the corresponding female buckle 144,146,148,150, the auxiliary bag 30 is secured to the primary bag 12.

The auxiliary bag 30 in addition to being carried by the carrying handle 118, can also be utilized as a backpack by the addition of a pair of back straps (not shown). Each backstrap includes an adjustable loop and on each end a male buckle that is inserted into the corresponding first, second, third and fourth female buckles 144, 146, 148 and 150 located on the auxiliary bag 30.

While the invention has been described in complete detail and pictorially shown in the accompanying drawings it is not to be limited to such details, since many changes and modifications may be made in the invention without departing from the spirit and scope thereof. For example, a set of foot pads can be added to the lower surface 14 of the primary bag 12 and the hand grip 102 can consist of a swivel handle. Hence, it is described to cover any and all modifications and forms which may come within the language and scope of the appended claims.

What is claimed is:

1. A utility bag comprising:

a) a primary bag having an upper surface, a lower surface, a front surface, a rear surface, a first side and a second side, said primary bag further having a removable, rigid liner comprised of a polystyrene material covered with a taffeta material having a PVC backing, and dimensioned to fit internally over the lower surface to add rigidity to the lower surface, b) an auxiliary bag having an upper seam that interfaces with an upper edge of a front surface and an upper edge of a rear surface said auxiliary bag further having a lower surface, a first side and a second side, and c) means for releasably attaching the rear surface of said auxiliary bag against the first side of said primary bag.

2. The utility bag as specified in claim 1 wherein said auxiliary bag has a portion of the first side consisting of a mesh material that allows the contents of said auxiliary bag to vent out of said auxiliary bag.

3. The utility bag as specified in claim 1 wherein said auxiliary bag further comprises a foam material encompassing the internal surface of the lower surface and a portion of the front and rear surfaces, wherein said foam material adds rigidity to the lower surface of said auxiliary bag.

4. The utility bag as specified in claim 1 wherein the front surface of said auxiliary bag has an opening covered by a zippered enclosure which allows access into the interior of said auxiliary bag.

5. A utility bag comprising:

a) a primary bag having:

(1) an upper surface, a lower surface, a first side, a rear surface, a first side and a second side, (2) a zipper that is substantially centered across the upper surface, (3) a first D-ring attached to the upper surface adjacent the first side and a second D-ring attached to the upper surface adjacent the second side, (4) a shoulder carrying strap having a first end and a second end, wherein the first end terminates in an adjustable loop having attached a first swivel hook that releasably engages the first D-ring, and the second end having attached a second swivel hook that releasably engages the second D-ring, wherein substantially centered on said strap is a non-slip shoulder paid that is slidably adjustable, (5) a pair of bag carrying straps, wherein a first strap has a first end and a second end attached respectively to the front surface, adjacent the first side and the second side, a second strap having a first end and a second end attached respectively to the rear surface, adjacent the first side and second side, of said primary bag, wherein the first strap has a substantially-centered hand grip dimensioned to wrap around the second strap and to become attached, by an attachment means, to thus form a hand grip, and (6) a water-proof zippered side pocket located on the first side, b) an auxiliary bag having:

(1) a front surface having an upper edge, a rear surface having an upper edge, a lower surface, a first side, a second side and an upper seam that joins the upper edge of the front surface and the upper edge of the rear surface, (2) a carrying handle attached across the front surface adjacent the upper edge, (3) a mesh material covering a portion of the first side, wherein said mesh material allows the contents of said auxiliary bag to vent, and (4) an opening covered by a zippered enclosure, wherein said opening is located on the front surface, and c) means for releasably attaching the rear surface of said auxiliary bag against the first side of said primary bag.

6. The utility bag as specified in claim 5 wherein said primary bag and said auxiliary bag are made of a waterproof, vinyl-backed polyester.

* * * * *